US009791117B2

(12) United States Patent
Rapeanu et al.

(10) Patent No.: US 9,791,117 B2
(45) Date of Patent: Oct. 17, 2017

(54) EMERGENCY LIGHTING FIXTURE WITH REMOTE CONTROL

(71) Applicant: Thomas & Betts International LLC, Wilmington, DE (US)

(72) Inventors: Radu C. Rapeanu, Mont-Royal (CA); Zhi Gang Xing, Pointe Claire (CA); Michel Lambert, Saint-Eustache (CA); Mohamed Elzayed, Montreal (CA); Chantal Dorval, Laval (CA)

(73) Assignee: Thomas & Betts International LLC, Wilmington, DE (US)

( * ) Notice: Subject to any disclaimer, the term of this patent is extended or adjusted under 35 U.S.C. 154(b) by 152 days.

(21) Appl. No.: 14/171,253

(22) Filed: Feb. 3, 2014

(65) Prior Publication Data

US 2014/0292506 A1 Oct. 2, 2014

Related U.S. Application Data

(60) Provisional application No. 61/807,427, filed on Apr. 2, 2013.

(51) Int. Cl.
*G08B 29/00* (2006.01)
*F21S 9/02* (2006.01)
(Continued)

(52) U.S. Cl.
CPC ..... *F21S 9/022* (2013.01); *F21V 23/045* (2013.01); *F21Y 2115/10* (2016.08)

(58) Field of Classification Search
CPC ..... F21S 9/022; F21Y 2101/02; F21V 23/045
(Continued)

(56) References Cited

U.S. PATENT DOCUMENTS 4,827,244 A 5/1989 Bellavia et al.
4,901,056 A 2/1990 Bellavia et al.
(Continued)

FOREIGN PATENT DOCUMENTS

CA 2284577 A1 1/1991
CA 2020090 A1 3/1991
(Continued)

OTHER PUBLICATIONS

"Patron LED—Die Cast Aluminum LED Wall Light/Unit (SD/ST Circuitry)." Philips Chloride. Jun. 29, 2012. Retrieved Feb. 3, 2014. http://www.chloridesys.com/chloride/chloridefixture.cfm?ID=3829.
(Continued)

*Primary Examiner* — Zhen Y Wu
(74) *Attorney, Agent, or Firm* — Taft Stettinius & Hollister LLP

(57) ABSTRACT

A processing unit in a dual-mode lighting fixture receives, via a light pipe of the lighting fixture, a test command signal from a remote control and initiates, based on the test command signal, testing for emergency condition lighting of the lighting fixture. The processing unit receives, via the light pipe, a control command signal from the remote control and controls, based on the control command signal, normal condition lighting of the lighting fixture. The processing unit also monitors feedback loops from a battery, a charger, or a set of LED lamps in the lighting fixture and presents, via the light pipe, a status color indication based on the monitored feedback.

19 Claims, 6 Drawing Sheets

(51) Int. Cl.
*F21V 23/04* (2006.01)
*F21Y 115/10* (2016.01)

(58) Field of Classification Search
USPC ..... 340/514
See application file for complete search history.

(56) References Cited

U.S. PATENT DOCUMENTS

| | | | | |
|---|---|---|---|---|
| 4,977,353 | A | 12/1990 | Helal et al. | |
| 5,148,158 | A * | 9/1992 | Shah | G08B 29/126 315/86 |
| 5,154,504 | A * | 10/1992 | Helal | G08B 29/14 315/86 |
| 5,559,499 | A | 9/1996 | Haubner | |
| 5,796,347 | A | 8/1998 | Zulaski | |
| 5,909,087 | A * | 6/1999 | Bryde | H05B 37/0263 315/149 |
| 5,929,781 | A * | 7/1999 | Vosika | G08B 29/126 315/134 |
| 6,392,349 | B1 | 5/2002 | Crenshaw | |
| 6,710,546 | B2 | 3/2004 | Crenshaw | |
| 6,756,736 | B2 | 6/2004 | Crenshaw | |
| 6,828,733 | B1 | 12/2004 | Crenshaw | |
| 8,192,039 | B1 * | 6/2012 | Moe | H02J 9/065 362/20 |
| 2002/0080027 | A1 * | 6/2002 | Conley, III | G08B 7/062 340/540 |
| 2002/0103796 | A1 * | 8/2002 | Hartley | G11B 27/105 |
| 2006/0012315 | A1 * | 1/2006 | McDonough | H05B 37/0209 315/291 |
| 2006/0139161 | A1 * | 6/2006 | Beghelli | G08B 25/009 340/514 |
| 2006/0146553 | A1 * | 7/2006 | Zeng | B60Q 11/002 362/488 |
| 2010/0237702 | A1 * | 9/2010 | Stocker | H02J 9/065 307/66 |
| 2011/0121739 | A1 * | 5/2011 | Ku | H05B 33/0812 315/158 |
| 2011/0235281 | A1 * | 9/2011 | Mittleman | H04M 1/0202 361/728 |
| 2012/0080944 | A1 * | 4/2012 | Recker | H02J 9/02 307/25 |
| 2013/0155331 | A1 * | 6/2013 | Fukumoto | H04N 5/64 348/725 |
| 2013/0342131 | A1 * | 12/2013 | Recker | H05B 33/0842 315/292 |

FOREIGN PATENT DOCUMENTS

| | | | |
|---|---|---|---|
| CA | 1303255 | C | 6/1992 |
| CA | 1311800 | A1 | 12/1992 |
| CA | 1315331 | A1 | 3/1993 |
| CA | 1320246 | C | 7/1993 |
| CA | 2185780 | C | 3/1997 |
| CA | 2100651 | C | 4/2000 |
| CA | 2288918 | A1 | 1/2001 |
| CA | 2214471 | C | 6/2005 |
| CA | 2523516 | A1 | 4/2006 |
| WO | 2010117742 | A2 | 10/2010 |
| WO | 2011005465 | A2 | 1/2011 |
| WO | 2012148585 | A1 | 11/2012 |
| WO | 2013008030 | A1 | 1/2013 |

OTHER PUBLICATIONS

"Diskuss—Die Cast Aluminum 'AC only or Emergency' LED Wall Light." Philips Chloride. May 2013. Retrieved Feb. 3, 2014. http://www.chloridesys.com/chloride/chloridefixture.cfm?ID=3834.

"Affinity Architectural Die-Cast Emergency Lighting." Lithonia Lighting. Mar. 11, 2013. Retrieved Feb. 3, 2014. http://www.lithonia.com/micro_webs/affinity/.

* cited by examiner

EMERGENCY LIGHTING FIXTURE WITH REMOTE CONTROL

CROSS-REFERENCE TO RELATED APPLICATION

This application claims priority under 35 U.S.C. §119, based on U.S. Provisional Patent Application No. 61/807,427 filed Apr. 2, 2013, the disclosure of which is hereby incorporated by reference herein.

BACKGROUND INFORMATION

The light-emitting diode (LED) has become a popular alternative to the incandescent bulb due to lighting performance and efficacy (lumen/watt), color rendering, and operational life. In emergency lighting, LED lamps provide additional cost savings by downsizing the required back-up energy (battery) and creating opportunities for equipment miniaturization. Certain types of emergency lights may generally appear like a regular lighting fixture, but include built-in emergency features.

DETAILED DESCRIPTION OF PREFERRED EMBODIMENTS

The following detailed description refers to the accompanying drawings. The same reference numbers in different drawings may identify the same or similar elements.

According to implementations described herein, an emergency lighting fixture may include a light pipe that employs bidirectional light transmission. The emergency lighting fixture may have dual-mode lighting (e.g., normal and emergency modes) that may be controlled via remote control.

According to one implementation, a dual-mode lighting fixture may include a set of light-emitting diode (LED) lamps, a battery to provide power to the set of LED lamps for emergency condition lighting, a charger to collect AC input to charge the battery, and a power supply to collect AC input to provide power to the set of LED lamps for normal condition lighting. The dual-mode lighting fixture may also include a status light to emit visible light indicative of a lighting fixture status, an infrared receiver to receive infrared signals from a remote control, and a processing unit. The processing unit may be configured to identify test commands received by the infrared receiver and initiate testing for emergency condition lighting; identify control commands received by the infrared receiver and initiate controls for normal condition lighting; and monitor feedback from the charger, the battery, and the LED lamps and control the status light based on the monitored feedback.

According to another implementation, a method of controlling a dual-mode lighting fixture may be performed by a processing unit in the lighting fixture. The processing unit may receive, via a light pipe of the lighting fixture, a test command signal from a remote control and may initiate, based on the test command signal, testing for emergency condition lighting of the lighting fixture. The processing unit may also receive, via the light pipe, a control command signal from the remote control and may control, based on the control command signal, normal condition lighting of the lighting fixture. The processing unit may also monitor a feedback loop from a battery, a charger, or a set of LED lamps in the lighting fixture and may present, via the light pipe, a status color indication based on the monitored feedback.

Figure 1:
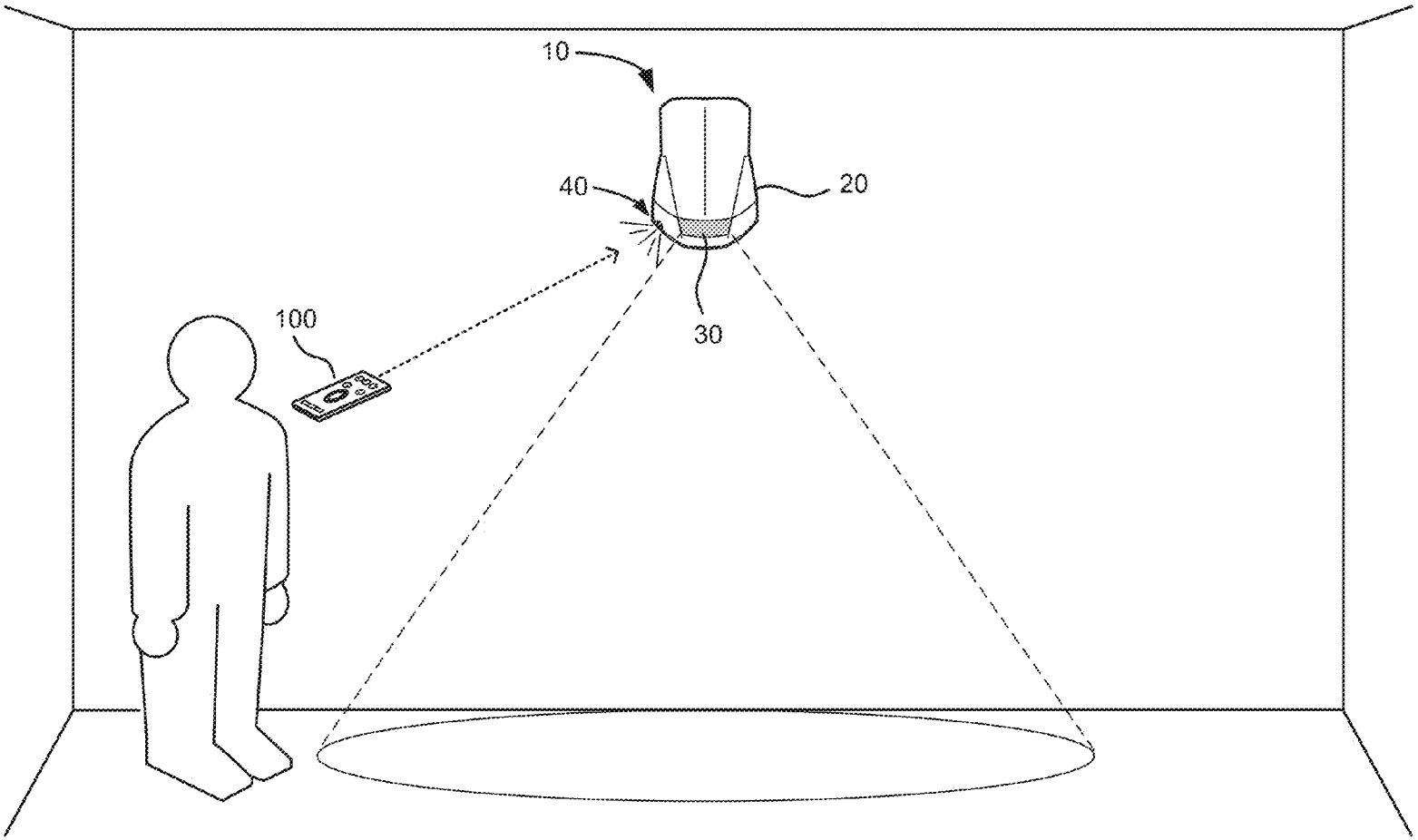
FIG. 1 is an illustration of an installed emergency lighting fixture according to an implementation described herein.

FIG. 1 is an illustration of an installed emergency lighting fixture 10 according to an implementation described herein. Referring to FIG. 1, lighting fixture 10 may include a housing 20, an illumination window 30 to provide illumination from an LED lighting engine (not shown), and an access hole 40 for a light pipe. Generally, lighting fixture 10 may be mounted high (e.g., approximately eight to sixteen feet from the floor/ground) on a vertical wall (e.g., with illumination window 30 facing downward) to provide downward illumination of a walking path or corridor. Lighting fixture 10 may receive signals from a remote control 100.

Figure 2:
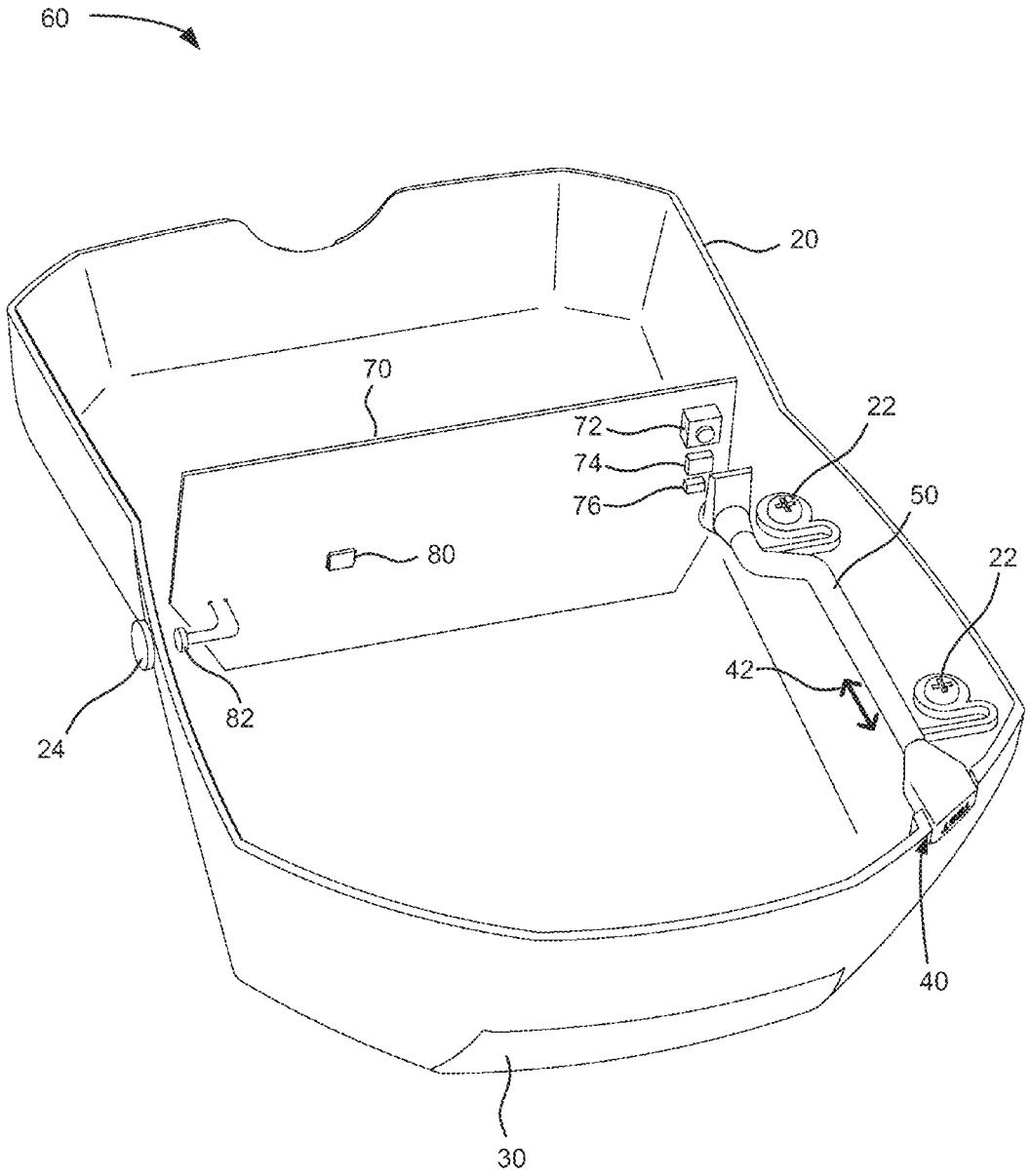
FIG. 2 is an illustration of a perspective view of an underside of a front cover of the emergency lighting fixture of FIG. 1.

FIG. 2 provides a perspective view of an underside of housing 20 front cover of emergency lighting fixture 10. A light pipe 50 may be secured to housing 20 and extend at one end through access hole 40. A printed circuit board 70 may be secured to housing 20 at an opposite end of light pipe 50. Other components of lighting fixture 10, such as the lighting engine and mounting hardware, are not shown in FIG. 2 for simplicity.

Referring collectively to FIGS. 1 and 2, housing 20 may include a rigid enclosure, such as metal or plastic, to secure illumination window 30, light pipe 50, printed circuit board 70, the lighting engine, and other components, such as a power supply, a controller, mounting hardware, and/or electrical circuitry (not shown). In conjunction with a back cover (not shown), housing 20 may provide a watertight enclosure and enable lighting fixture 10 to be secured to a wall or another surface. Housing 20 may include a generally rectangular opening in which to secure illumination window 30 and a smaller access hole 40 to contain light pipe 50. Housing 20 may provide a structure on which to mount light pipe 50. More particularly, fasteners 22 may be used to secure and position brackets of light pipe 50, so as to position one end of light pipe 50 in access hole 40 and another end of light pipe 50 adjacent to printed circuit board 70.

Illumination window 30 may include a generally transparent panel inserted into the opening of housing 20. Window 30 may be made from, for example, clear polycarbonate or glass. As shown in FIG. 1, Illumination window 30 may permit light from an LED light engine to pass through to provide illumination to an area below illumination window 30.

Access hole 40 may include an opening in housing 20 to expose an end of light pipe 50 outside of housing 20. As described further herein, access hole 40 may be sized to permit movement of light pipe 50 within access hole 40 (e.g., in a direction indicated by arrow 42). In one implementation, access hole 40 may include one or more seals to reduce entrance of moisture and/or contaminants inside housing 20. Also, as shown in the implementation of FIG. 1, access hole 40 may be positioned to face generally downward (when emergency lighting fixture 10 is installed) to prevent moisture ingress.

Figure 3A:
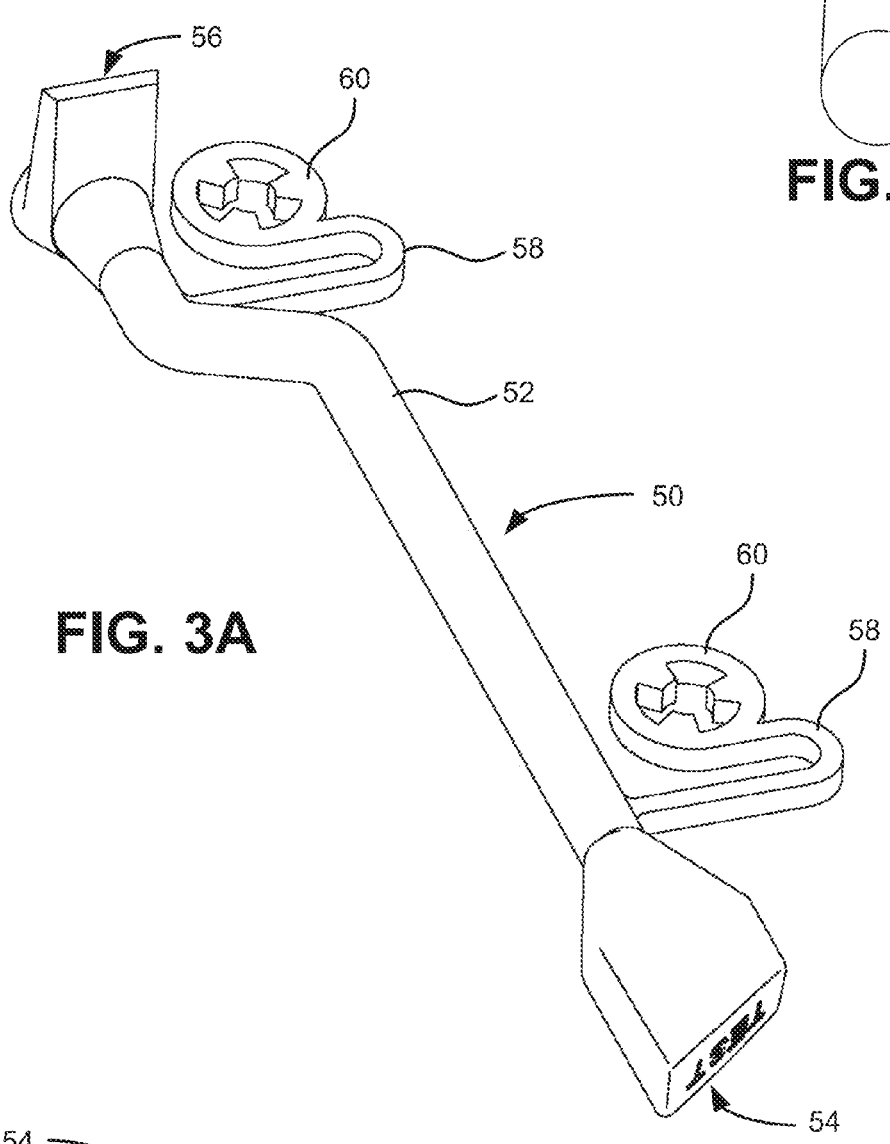
FIG. 3A is an illustration of a perspective view of a light pipe of the front cover of FIG. 2.
Figure 3C:
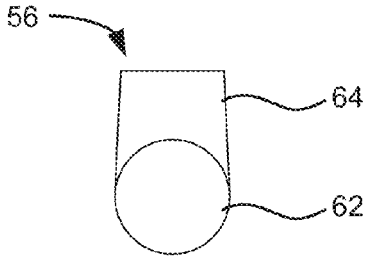
FIG. 3C is a diagram of an end view of a cone base portion of the light pipe of FIG. 3A.
Figure 3B:
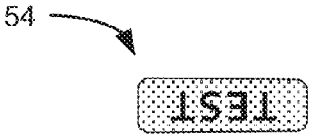
FIG. 3B is a diagram of an end view of a display end portion of the light pipe of FIG. 3A.

Light pipe 50 may be installed within housing 20. Light pipe 50 may perform multiple functions for emergency lighting fixture 10, including a mechanical force transfer, infrared light transmission from outside of housing 20, and visible light transmission from inside of housing 20. FIG. 3A is an illustration of a perspective view of light pipe 50. FIG. 3B is a diagram of an end view of a display end 54 of light pipe 50, and FIG. 3C is a diagram of an end view of a cone base 56 of light pipe 50. Referring collectively to FIGS. 2-3C, light pipe 50 may include essentially a solid cylinder or rod 52 made of clear, semi-rigid plastic material such as polycarbonate. Light pipe 50 may include display end 54 at one end and cone base 56 at an opposite end. Light pipe 50 may also include two thin U-shaped connectors 58, each ending with a terminal ring 60 for securing light pipe 50 to housing 20. In one implementation, light pipe 50 may be molded as a single piece.

Display end 54 may be exposed outside housing 20 (e.g., through access hole 40). In one implementation, the exposed surface of display end 54 may be textured with wording molded into the surface. The texture may provide for even illumination of display end 54 when light is applied to light pipe 50 at cone base 56. The wording may include a different texture or edges that give the letters a different appearance than the rest of the textured surface. For example, display end 54 may include the word TEST molded into display end 54.

Cone base 56 may have a flat and clear surface positioned in the vicinity of and generally parallel to a surface of printed circuit board 70. In one implementation, cone base 56 may include a light transmitting portion 62 and a contact portion 64.

U-shape connectors 58 may act as springs to allow for a small displacement of light pipe 50 (e.g., in the direction of arrow 42) when display end 54 is pushed from outside of housing 20 (e.g., with a finger). U-shape connectors 58 may also provide sufficient retention force to return light pipe 50 to an original position after a push is removed.

Printed circuit board 70 may include three electrical components installed behind cone base 56 of light pipe 50: a push-button switch 72, an infrared (IR) remote receiver 74, and a light-emitting diode (LED) 76. Other components of printed circuit board 70, such as a processing unit 80 and photo-cell 82 are described further in connection with FIG. 4. Still referring to FIGS. 2-3C, when installed in housing 20, contact portion 64 of light pipe 50 may be aligned with push-button switch 72 on printed circuit board 70. Additionally, light transmitting portion 62 may be generally aligned with IR remote receiver 74 and LED 76.

Push-button switch 72 may invoke a manual test of emergency lighting for emergency lighting fixture 10. Pushing (e.g., by a user's finger) display end 54 may cause contact portion 64 of cone base 56 to contact push-button switch 72. In one implementation, push-button switch 72 may replicate commands described below in conjunction with key 102 of remote control 100.

IR remote receiver 74 may be a standard integrated circuit that detects infrared light from a remote control (e.g., remote control 100) and translates the received infrared light into a series of digital pulses for reading by a processing unit (e.g., processing unit 80). According to an implementation described herein, infrared light signals from remote control 100 may be transmitted from the display end 54 of light pipe 50 to IR remote receiver 74 via the base end 56.

Signal light 76 may be a bi-color LED and may also be powered through processing unit 80. In another implementation, multiple lights may be used in place of a single bi-color light. Signal light 76 may be controlled by processing unit 80 to function as a pilot light (e.g., green color) or as a diagnostic display (e.g., red color: steady or flashing). According to an implementation described herein, visible light from signal light 76 may be transmitted from base end 56 of light pipe 50 to display end 54 for display outside of housing 20.

Figure 4:
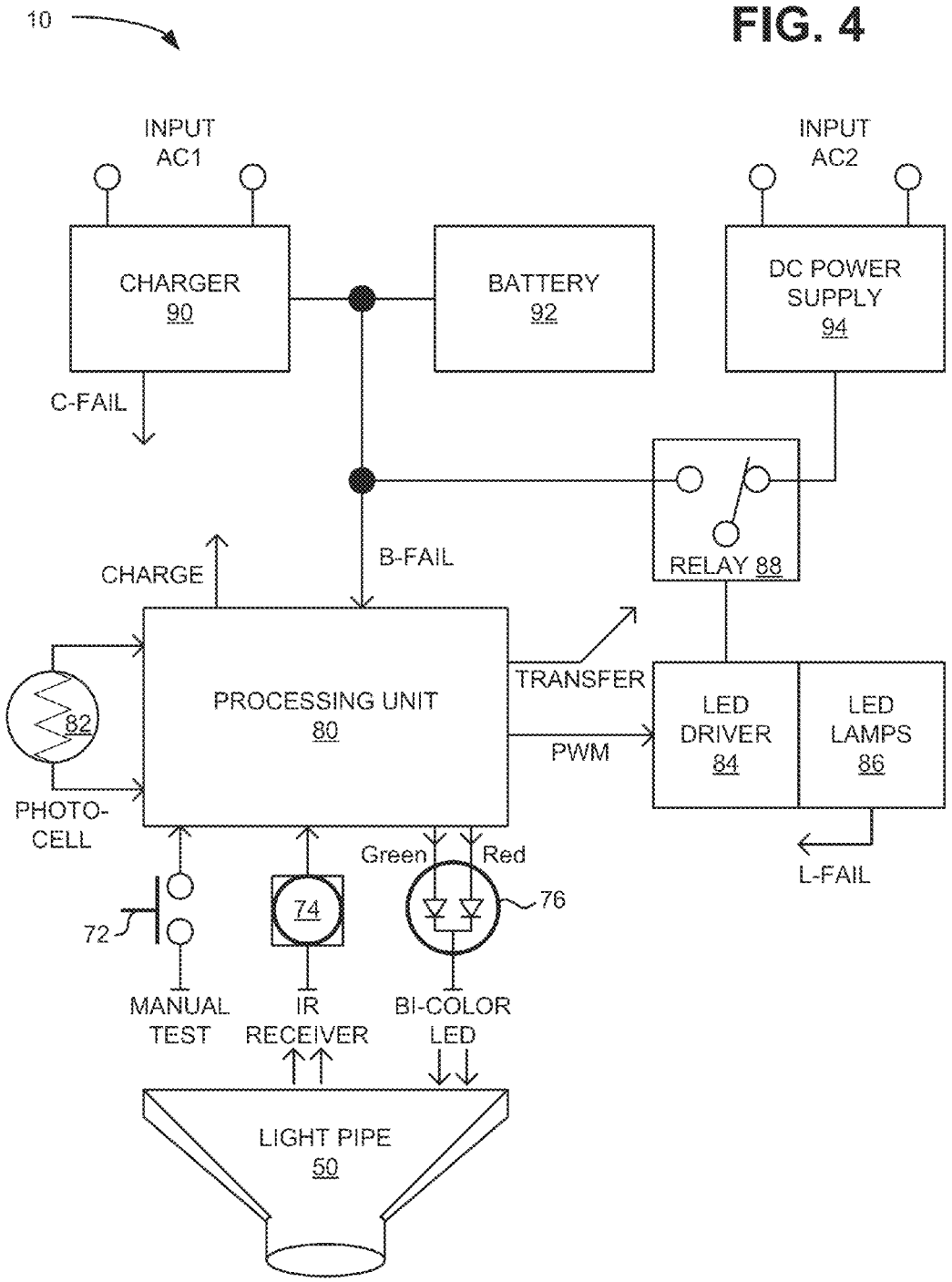
FIG. 4 is a block diagram of an electrical circuit of the emergency lighting fixture of FIG. 1, according to an implementation described herein.

FIG. 4 is an electrical block diagram of the emergency lighting fixture 10. As shown in FIG. 4, emergency lighting fixture 10 may be configured with bidirectional light pipe 50 and remote control capabilities for dual-mode lighting. As shown in FIG. 4, emergency lighting fixture 10 may include light pipe 50, push-button switch 72, IR remote receiver 74, LED 76, processing unit 80, a photo-cell 82, an LED driver 84, LED lamps 86, a relay 88, a charger 90, a battery 92, and a DC power supply 94.

As a dual-mode lighting fixture, emergency lighting fixture 10 may provide normal condition lighting (e.g., when electric power is being supplied to a building, etc.) and emergency condition lighting (e.g., battery powered lighting when a power outage occurs). Emergency lighting fixture 10 may be supplied from two AC utility lines, shown in FIG. 4 as AC1 and AC2. AC1 may be dedicated to emergency lighting components (e.g., charger 90 and battery 92). AC2 may supply power (e.g., to DC power supply 94) for normal condition lighting.

For both emergency condition lighting and normal condition lighting, illumination from emergency lighting fixture 10 can be provided via LED lamps 86 powered in constant current by LED driver 84 circuit. In one implementation, LED lamps 86 may be mounted at different angles and fitted with different lenses to optimize light distribution. Power for LED driver 84 can be supplied either by battery 92 (e.g., for emergency lighting) or DC power supply 94 (e.g., for normal lighting) via the selected contacts of relay 88.

Charger 90 may include a charger to produce an electrical connection with battery 92 to charge battery 92 using, for example, current from input AC1. Battery 92 may include one or more rechargeable nickel-metal hydride, nickel cadmium, lithium, or another type of battery. In another implementation, a disposable battery may be substituted for charger 90 and battery 92.

Processing unit 80 may include one or more processors or microprocessors that interpret and execute instructions. Processing unit 80 may also be referred to as a controller or microcontroller. In other implementations, processing unit 80 may be implemented as or include one or more application specific integrated circuits (ASICs), field programmable gate arrays (FPGAs), or the like. Generally, processing unit 80 may manage all the functions of components in emergency lighting fixture 10. Such functions may include battery charging and stand-by (e.g., by charger 90), transfer and/or selection of lighting mode (e.g., via relay 88), light intensity level (e.g., by applying pulse-width modulation (PWM) or alternate algorithms to LED driver 84), pilot light and diagnostic display (e.g., by status light 76), performing remote control commands (e.g., received via IR remote receiver 74), performing manual test commands (e.g., received via push-button switch 72), and adjusting normal conditions lighting for changing ambient light conditions (e.g., based on signals from photo-cell 82). Processing unit 80 may also execute other functions typical to emergency lighting, such as performing automatic and periodic self-test of the unit (monthly, annually, etc.), transferring to emergency lighting upon detection of power failure, disconnecting battery 92 at the end of the discharge, etc.

In one implementation, processing unit 80 may monitor the voltage and current levels of the main blocks of emergency lighting fixture 10, with the inputs from charger 90 (C-FAIL), battery 92 (B-FAIL), and LED lamps 86 (L-FAIL). In the event of a failure detection (e.g., from any of the C-FAIL, B-FAIL, or L-FAIL inputs), processing unit 80 can set the color of bi-color LED 76 from green (e.g., indicating normal operation) to red and will flash the light with a particular code that indicates the type of failure (e.g., charger failure, battery failure, or lamp failure).

Light pipe 50 may provide user access to the three main control functions (manual test, remote control, and bi-color LED display) of emergency lighting fixture 10. IR remote receiver 74 is insensitive to visible light emitted by bi-color LED 76. Thus, transmission of visible light from bi-color LED 76 and reception of infrared light by IR remote receiver 74 can be independent and may happen simultaneously. Use of bi-directional light pipe 50 eliminates the need of a secondary printed circuit board and/or harness for IR remote receiver 74, which simplifies manufacturing and reduces costs of emergency lighting fixture 10.

As shown in FIG. 2, in one implementation, housing 20 may include an additional window 24 to provide ambient light to photo-cell 82. Photo-cell 82 may provide signals to trigger dusk-to-dawn activation of normal condition lighting. The ambient light levels (e.g., through window 24) for "dusk" and "dawn" are converted by photo-cell 82 into electrical signals and can be stored by processing unit 80 in flash memory following a calibration sequence at the factory.

In one implementation, photo-cell 82 may be calibrated on printed circuit board 70 in the factory before printed circuit board 70 is inserted onto assembled emergency lighting fixture 10. The calibration may be performed with an automated test system, as part of a general test procedure for printed circuit board 70. The calibration processes may use a small light source with a preset intensity level. Processing unit 80 may read and memorize the value of photo-cell 82 resistance under these conditions (e.g., with the small light source applied). The resistance value may then be used to calculate two threshold levels (e.g., a certain percentage above and a certain percentage below the memorized resistance value) for "dusk" and for "dawn" ambient lighting, which correspond to when processing unit 80 switches the normal lighting on and off. The simplified automated calibration procedure is more efficient than, for example, the calibration of regular light-sensitive switches which is typically done manually, by adjusting a potentiometer in the electrical circuit.

Figure 5:
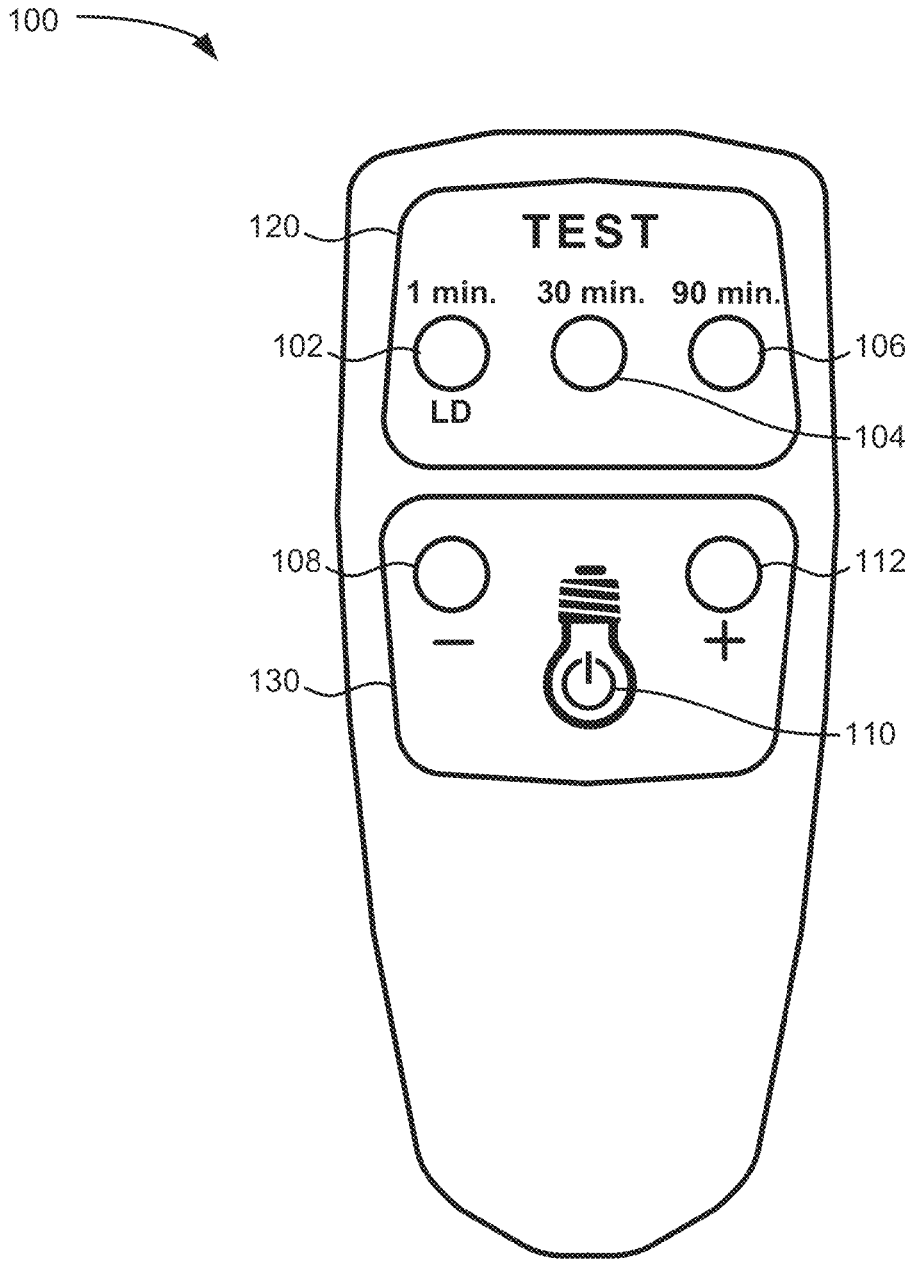
FIG. 5 is a front view of a remote control for the emergency lighting fixture of FIG. 1.

In one implementation, the circuit architecture for emergency lighting fixture 10 shown in FIG. 4 may accept independent remote control commands for both emergency lighting and normal lighting modes. FIG. 5 is a front view of remote control 100 that may provide infrared command signals to emergency lighting fixture 10. Referring to FIG. 5, remote control 100 may include six keys 102, 104, 106, 108, 110, and 112, clustered in two distinct areas, an emergency test command area 120 and a normal lighting command area 130. In one implementation, keys 102, 104, 106, 108, 110, and 112 may be color coded.

As shown in FIG. 5, the three upper keys 102, 104, and 106 in area 120 may be dedicated to emergency lighting commands. In normal conditions (e.g., when AC power is present), each of keys 102, 104, and 106 can be used to initiate a test (of battery-powered lighting) for a specific duration: a short duration, such as one minute (e.g., key 102); a medium duration, such as thirty minutes (e.g., key 104); and a long duration, such as ninety minutes (e.g., key 106). For example, each of keys 102, 104, and 106 may cause remote control 100 to generate different signals that may be received by processing unit 80 to initiate a test for a particular duration for emergency condition lighting. The actual time value assigned to each test duration may correspond to, for example, requirements in published health and safety codes. In one implementation, a test in progress can be aborted by again pushing any of test keys 102, 104, and 106.

During a power failure, one of the test keys (e.g., key 102) may also have a second function referred to herein as a lamp disconnect (LD). The LD command may allow a user to turn off emergency lights (e.g., to save battery power) if an area is otherwise illuminated (e.g., in daylight). The emergency lights can be toggled on/off, for example, by pushing the key 102 repeatedly. As noted above, features of key 102 may be duplicated by push-button switch 72.

Still referring to FIG. 5, the three lower keys 108, 110, and 112 in area 130 may serve to control normal lighting. The key in the middle (e.g., key 110) may be the on/off light switch. The other keys (e.g., keys 108 and 112) may control the light intensity level (e.g., dimming) of LED lamps 86: each time one of keys 108 or 112 is pushed, processing unit 80 may increase (for key 112) or decrease (for key 108) the light from LED lamps 86 by a certain level, between a minimum and a maximum brightness. In one implementation, the most recent dimming level can be memorized (e.g., by processing unit 80) when normal lighting is switched off. In the event of a power outage, the normal lighting condition (e.g., on/off, dimming) may be memorized until the power restoration. Also, when the power outage is detected, emergency lighting fixture 10 may transfer automatically to emergency lighting mode.

In one implementation, certain conditions and priorities may apply between the remote control functions. For example, a test command (e.g., for emergency lighting from one of keys 102, 104, or 106) may disable the normal lighting for the duration of a specific test. Also, dimming controls (keys 108 and 112) may work only when normal lighting is on. Furthermore, in one implementation, light intensity in emergency lighting mode may be factory-set and may not be dimmed.

According to implementations described herein, the use of remote control 100 for dual-mode lighting simplifies the control by the user of the functions and features of emergency lighting fixture 10. Remote control 100 may enable the user to both test emergency condition lighting and to conserve battery power by turning off the emergency lights during a power failure (e.g., if the area receives daylight) via the lamp disconnect feature. Remote control 100 may eliminate the need for a wall switch for normal lighting, may costs less (e.g., since no wiring for a wall switch is need), and may provide a simple dimming function.

Figure 6:
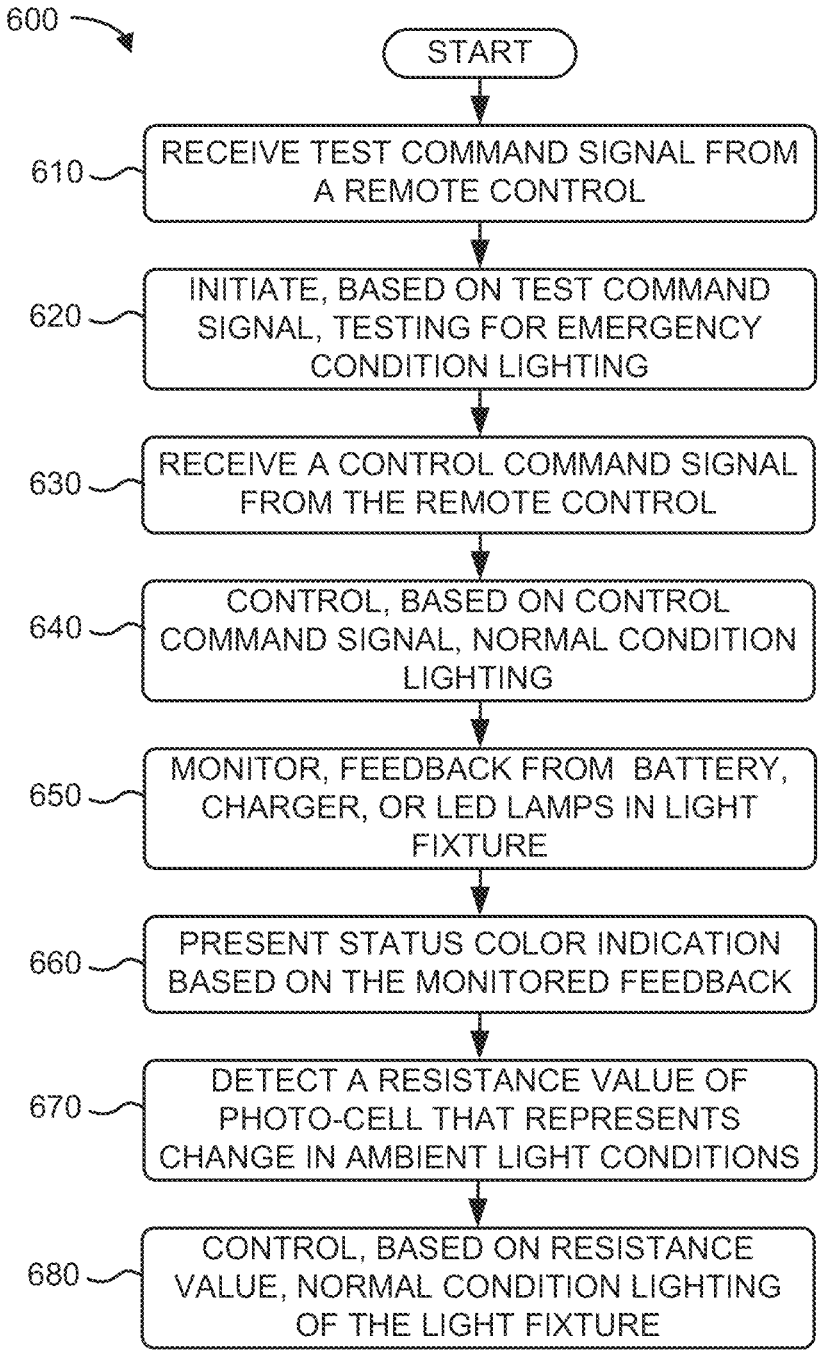
FIG. 6 is a flow diagram of a process for controlling a dual-mode lighting fixture, according to an implementation described herein.

FIG. 6 is a flow diagram of a process for controlling a dual-mode lighting fixture, according to an implementation described herein. In one implementation, process 600 may be performed by processing unit 80. In other implementations, some or all of process 600 may be performed by one or more other devices from lighting fixture 10 or remote control 100. Process 600 is described with reference to components in figures described above.

Process 600 may include receiving a test command signal from a remote control (block 610), and initiating, based on the test command signal, testing for emergency condition lighting of the lighting fixture (block 620). For example, processing unit 80 may receive a test signal initiated by one of keys 102, 104, or 106 of remote control 100. The corresponding infrared test signal may be received at IR remote receiver 74 via light pipe 50 and sent to processing unit 80. Processing unit 80 may receive the test signal and initiate a test of emergency condition lighting for lighting fixture 10 (e.g., by controlling relay 88 to provide power from battery 92 to LED driver 84).

Process 600 may also include receiving a control command signal from the remote control (bock 630), and controlling, based on the control command signal, normal condition lighting of the lighting fixture (block 640). For example, processing unit 80 may receive a control signal initiated by one of keys 108, 110, or 112 of remote control 100. The corresponding infrared control signal may be received at IR remote receiver 74 via light pipe 50 and sent to processing unit 80. Processing unit 80 may receive the control signal and activate and/or adjust normal condition lighting for lighting fixture 10 (e.g., by controlling relay 88 to provide power from DC power supply 94 to LED driver 84 and/or signaling LED driver to adjust brightness of LED lamps 86).

Process 600 may also include monitoring feedback from a battery, a charger, or a set of LED lamps in the lighting fixture (block 650), and presenting a status color indication based on the monitored feedback (block 660). For example, processing unit 80 may monitor feedback circuits from any of battery 92, charger 90, or LED lamps 86. Processing unit 80 may control the illumination color of bi-color LED 76 to indicate whether the feedback loops are functioning normally. For example, processing unit 80 may set the color of bi-color LED 76 to green for normal operation or red for a component failure. In one implementation, processing unit 80 may cause the red LED 76 to flash a particular pattern to indicate a type of failure (e.g., charger failure, battery failure, or lamp failure).

Process 600 may further include detecting a resistance value of a photo-cell that represents a change in ambient light conditions (block 670), and controlling, based on the resistance value, the normal condition lighting of the lighting fixture (block 680). For example, photo-cell 82 may convert ambient light levels into electrical signals. Processing unit 80 may compare the electrical signals with stored setting corresponding to "dusk" and "dawn" thresholds for ambient lighting. When signals from photo-cell 82 indicate a "dusk" or "dawn" threshold is crossed, processing unit 80 may switch the normal condition lighting on or off.

According to implementations described herein a processing unit in a dual-mode lighting fixture may receive, via a light pipe of the lighting fixture, a test command signal from a remote control and may initiate, based on the test command signal, testing for emergency condition lighting of the lighting fixture. The processing unit may also receive, via the light pipe, a control command signal from the remote control and may control, based on the control command signal, normal condition lighting of the lighting fixture. The processing unit may also monitor feedback from a battery, a charger, and/or a set of LED lamps in the lighting fixture and may present, via the light pipe, a status color indication based on the monitored feedback.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A dual-mode lighting fixture, comprising:

a set of light-emitting diode (LED) lamps;

a battery to provide power to the set of LED lamps for emergency condition lighting when no electric power is supplied for the dual-mode lighting fixture;

a charger to receive alternating current (AC) input to charge the battery;

a power supply to receive AC input to provide power to the set of LED lamps for normal condition lighting when electric power is supplied for the dual-mode lighting fixture;

a printed circuit board including:

a status light to emit visible light indicative of a lighting fixture status, an infrared receiver to receive infrared signals from a remote control, and a manual switch to provide a test command signal;

a light pipe including a rod with a base end and a display end, the base end comprising:

a light transmitting portion aligned with the status light and the infrared receiver, and a contact portion aligned with the manual switch, wherein the light pipe transmits light from the status light via the light transmitting portion to the display end, transmits infrared signals from the display end to the infrared receiver via the light transmitting portion, and transfers a manual force applied at the display end to the manual switch via the contact portion; and a processor configured to:

identify first commands received by the infrared receiver and initiate testing for the emergency condition lighting, identify second commands received by the infrared receiver and initiate controls for providing power to the set of LED lamps for the normal condition lighting, identify a manual command received by the manual switch and initiate testing for the emergency condition lighting, and monitor feedback from the charger, the battery, and the set of LED lamps and control the status light based on the monitored feedback.

2. The dual-mode lighting fixture of claim 1, wherein the set of LED lamps are dimmable for the normal condition lighting and are of a fixed intensity for the emergency condition lighting.

3. The dual-mode lighting fixture of claim 1, further comprising:

a housing configured to enclose the set of LED lamps, the battery, the charger, the power supply, the status light, and infrared receiver, and the processor, wherein the housing includes a single opening to both receive the infrared signals and display the visible light from the status light via the light pipe.

4. The dual-mode lighting fixture of claim 1, wherein the light pipe comprises a clear polycarbonate material.

5. The dual-mode lighting fixture of claim 1, wherein the visible light indicative of the lighting fixture status includes at least two alternating colors of visible light.

6. The dual-mode lighting fixture of claim 1, further comprising:

a photo-cell configured to alter resistance based on ambient lighting conditions, wherein the processor is further configured to:

identify changes in the resistance of the photo-cell, and activate or deactivate normal condition lighting based on the identified changes in the resistance.

7. The dual-mode lighting fixture of claim 1, wherein the first commands received by the infrared receiver include commands to initiate:

a short-duration test of the emergency condition lighting, a medium-duration test of the emergency condition lighting, and a long-duration test of the emergency condition lighting.

8. The dual-mode lighting fixture of claim 7, wherein the first commands received by the infrared receiver include commands to turn off the emergency condition lighting.

9. The dual-mode lighting fixture of claim 1, wherein the second commands received by the infrared receiver include commands to:

turn on or turn off the normal condition lighting, and change the intensity of the normal condition lighting.

10. The dual-mode lighting fixture of claim 1, wherein the light pipe further comprises one or more connectors by which the light pipe is secured to a housing, and wherein the one or more connectors provide sufficient retention force to return the light pipe to an original position after the manual force is removed.

11. The dual-mode lighting fixture of claim 1, wherein the rod comprises a solid cylinder.

12. A method for controlling a dual-mode lighting fixture, comprising:

receiving, at a processor of the lighting fixture, a first infrared command signal from a remote control, wherein the first infrared command signal is received via a light pipe, the light pipe including a rod with a display end exposed outside a housing of the light fixture and a base end adjacent to a printed circuit board within the housing, the printed circuit board including an infrared receiver;

initiating, by the processor and based on the first infrared command signal, testing for emergency condition lighting of the dual-mode lighting fixture to power an LED lamp when no electric power is supplied to the dual-mode lighting fixture;

receiving, at the processor and via the light pipe, a second infrared command signal from the remote control, wherein the second infrared command signal is received via the infrared receiver;

controlling, by the processor and based on the second infrared command signal, normal condition lighting of the dual-mode lighting fixture to power the LED lamp when electric power is supplied for the dual-mode lighting fixture;

monitoring, by the processor, feedback from a battery circuit, a charger circuit, or an LED lamp circuit in the dual-mode lighting fixture;

presenting, by the processor and via the light pipe, a status color indication based on the monitored feedback, wherein the status color indication is provided by a status light affixed to the printed circuit board;

receiving application of manual force to the display end;

transferring, by the light pipe, the manual force to activate a physical switch on the printed circuit board; and initiating, by the processor and based on the activation of the physical switch, a test for the emergency condition lighting.

13. The method of claim 12, further comprising:

detecting a resistance value of a photo-cell that represents a change in ambient light conditions; and controlling, based on the resistance value, the normal condition lighting of the dual-mode lighting fixture.

14. The method of claim 12, wherein presenting the status color indication includes switching between at least two different colors of visible light.

15. The method of claim 12, wherein the first infrared command signal includes a command to initiate a test from a group of tests including:

a short-duration test of the emergency condition lighting, a medium-duration test of the emergency condition lighting, and a long-duration test of the emergency condition lighting.

16. The method of claim 12, wherein the second infrared command signal includes a command from a group of commands including:

toggling the normal condition lighting on or off, dimming the normal condition lighting, and brightening the normal condition lighting.

17. An dual-mode lighting fixture, comprising:

a set of light-emitting diode (LED) lamps;

a battery to provide power to the set of LED lamps for emergency condition lighting when no electric power is supplied for the dual-mode lighting fixture;

a power supply to receive AC input to provide power to the set of LED lamps for normal condition lighting when electric power is supplied for the dual-mode lighting fixture;

a printed circuit board including:

a status light to emit visible light indicative of a lighting fixture status, an infrared receiver to receive infrared signals from a remote control, and a processor;

a light pipe including a base end, a rod, and a display end, the base end comprising a light transmitting portion aligned with the status light and the infrared receiver, wherein the light pipe transmits visible light from the status light through the rod to the display end, and transmits infrared signals from the display end through the rod to the infrared receiver via the base end; and the processor configured to: identify first commands received by the infrared receiver and initiate testing for emergency condition lighting based on the first commands, identify second commands received by the infrared receiver and initiate controls for providing power to the set of LED lamps for the normal condition lighting based on the second commands, and monitor conditions of the battery and the set of LED lamps and control the status light based on the monitored conditions, a manual switch to provide a test command signal, wherein the light pipe is further configured to transfer a manual force applied at the display end to the manual switch.

18. The dual-mode lighting fixture of claim 17, further comprising:

a photo-cell configured to alter resistance based on ambient lighting conditions, wherein the processor is further configured to:

identify changes in the resistance of the photo-cell, and activate or deactivate normal condition lighting based on the identified changes in the resistance.

19. The dual-mode lighting fixture of claim 17, further comprising:

a housing configured to enclose the set of LED lamps, the battery, the power supply, the status light, and infrared receiver, and the processor, wherein the housing includes a single opening to both receive the infrared signals and display the visible light from the status light via the light pipe.

* * * * *